US006739280B2

(12) United States Patent
Keller

(10) Patent No.: US 6,739,280 B2
(45) Date of Patent: May 25, 2004

(54) BOAT WITH SWING SEATING

(75) Inventor: Rogenald J. Keller, 204 N. Minnesota Ave., St. Peter, MN (US) 56082

(73) Assignee: Rogenald J. Keller, St. Peter, MN (US)

( * ) Notice: Subject to any disclaimer, the term of this patent is extended or adjusted under 35 U.S.C. 154(b) by 88 days.

(21) Appl. No.: 10/318,429

(22) Filed: Dec. 12, 2002

(65) Prior Publication Data

US 2003/0097972 A1 May 29, 2003

Related U.S. Application Data

(63) Continuation-in-part of application No. 09/993,001, filed on Nov. 26, 2001, now abandoned.

(51) Int. Cl.[7] ..... B63B 17/00

(52) U.S. Cl. ..... 114/363; 114/343; 114/360; 114/364

(58) Field of Search ..... 114/363, 364, 114/343, 361, 68, 69, 360, 26; 297/344.21, 344.22, 344.26; 441/80

(56) References Cited

U.S. PATENT DOCUMENTS

| | | | | | |
|---|---|---|---|---|---|
| 1,764,585 | A | * | 6/1930 | Taylor | 114/79 W |
| 2,714,387 | A | | 8/1955 | Meldrum | |
| 3,152,570 | A | * | 10/1964 | Dyer | 114/69 |
| 4,460,216 | A | * | 7/1984 | Keller | 297/188.01 |
| 4,620,686 | A | * | 11/1986 | Conant | 248/415 |
| 4,773,887 | A | | 9/1988 | Steffanus | |
| 4,974,537 | A | * | 12/1990 | Martin | 114/255 |
| 4,979,458 | A | * | 12/1990 | Bouza | 114/363 |
| 5,265,555 | A | * | 11/1993 | Hodge, Jr. | 114/343 |
| 5,492,076 | A | | 2/1996 | Kobayashi | |
| 5,884,575 | A | * | 3/1999 | Talasimov | 114/39.11 |

FOREIGN PATENT DOCUMENTS

| | | |
|---|---|---|
| WO | WO 97/29184 | 8/1997 |

* cited by examiner

*Primary Examiner*—Sherman Basinger

(57) ABSTRACT

The focus of the new inventions here is on safety from injury and the lessening of the current loss of life in the use and pleasure desired by the American Public from the small, motor powered, open planing hull, first introduced to the world by Ole Evinrude in 1908. Specifically, thought is introduced about people riding on the top deck of a boat rather than down in a boat. Mention is made of swing chair seating, and it's support of high safety rails, as well as the all-round good view the driver has because of having his seat and console mounted on the top deck. Furthermore, discussion is developed on the advantages and dependability of the inertia control swing pivot used under the chairs which are mounted on the frames of the swing chair system. Some mention is made of the expected nationwide use of the boat with swing chairs as ambulance and police boats. Presentations are made of the non swamp ability of the complete flat top deck, and the expected projection of the less likelihood of boats capsizing is in the offing. The less number of collisions is expected because of the high view, over all, that the driver has because of being up on the top deck.

21 Claims, 14 Drawing Sheets

SECTION B-B

SECTION A-A

BOAT WITH SWING SEATING

This application is a Continuation-in-Part of Parent patent application Ser. No. 09/993,001 filed Nov. 26, 2001 entitled KELLER RIDE ON PRINCIPLE, which is now abandoned. My boat is completely flat decked, has at least four swing seats, plus, it has railings on both sides and across the transom.

BACKGROUND OF THE INVENTION

The conventional practice of people riding in a planing boat has been to ride down in the boat, probably because boats were conventionally constructed to accommodate them in the lower portions of the boat. As a consequence, both the passengers and the driver rode in the lower portions of the boat. The instrument panel, console; or helm were usually mounted directly in front of the driver and most, if not all, of the passengers were located in what has been known as the "catch basin", most of which was located at and slightly rearward of amidships.

As a consequence of the above, the driver in an effort to reach shelter and relative safety in a minimum of time would apply the necessary power and, in doing so, he causes the boat bow to elevate and obstruct his forward vision, which in turn, increases danger of collision with other boats, and possible passenger injuries.

The existence of the "catch basin" at the lowermost portions of the boat and the location of its passengers therein or closely adjacent thereto has substantially contributed to the relatively frequent "swamping" of boats in which the entire boat fills with water, frequently leading to injuries and drowning.

Close quarters of passengers and mixing thereof with supplies and baggage frequently lead to confusion and accidents, including injuries. My boat is designed to provide a clear deck for occupation by the passengers, to thereby obviate the problems which are an outgrowth of the conditions, as described above. I have eliminated the "catch basin" and its many disadvantages.

The prior confusion of people occupying the same identical space as their supplies, their seating, their currently used equipment and the lack of adequate railings for them to lean against and generally enjoy themselves without fear of falling overboard has been accepted as part of normal boating life.

In addition, power has been added currently to the small open planing power boat that is under the Coast Guards 26 foot length limits for such craft to the extent that the prior art seats mounted directly over a pedestal under the center of the seats' base are unsafe, because the extremely high speeds that are now easily reached, subject the boat to a resultant vector force of great power when the boat smashes into unyielding high water and it can instantly jam the boat and all its firmly fastened parts directly away in the line of flight of the incoming vector. The seat goes too, out from under the sitting rider, due to the inertia of the rider's body.

Contrarily, my inertia controlled swing pivot mounting beneath the base of my seat uses the inertia of the rider and the base itself to swing and catch the rider safely.

My complete flat deck allows for no swamping or capsizing.

My unique high railings practically eliminate people falling overboard.

The high elevation of the people on my decks provide for 360 degree unobstructed vision for all, therefore, much less chance of collisions killing and maiming.

Attaching paneling beneath the parallel railing and its directly beneath boat side edge provide splash protection and keeps small children from crawling out under the railing.

BRIEF SUMMARY OF THE INVENTION

An important advantage of my boat is the retention of substantially all of the horizontal space within the boat at the passenger level, for the passengers convenience and enjoyment. This is made possible by retaining all of the area of the lower deck for supplies, and all other objects other than ordinary supplies, while the passengers frequent only the upper deck. This upper deck extends across the entire open area at the level of the top of the sidewalls of the boat. The top of such sidewalls were frequently, in earlier years, called "gunnels". The upper deck of my boat is clear of most everything but the console or helm, and even that area can be increased by swinging the swingable chairs (with or without the passengers therein) outwardly beyond the sidewalls of the boat.

The upper deck of my boat extends from bow to stern and from the upper surface of one sidewall to the upper surface of the opposite sidewall, all at the level of the upper surface of the sidewalls of the boat. This provides a relatively spacious area to accommodate the passengers and, along with the high hand rails, promotes safety. The hand rails at each side and at the rear of my boat are at least 34 inches high. The chair seats are disposed approximately 16 inches above the deck. As a consequence, the chairs can be swung outwardly of the sidewalls of the boat and the passengers may or may not remain in them at that position. Actually, if the dock height is OK, the swing seats may be used as a debarking or boarding device. Many handicapped people would like to go boating, too.

The most important aspect of my upper deck, however, is that it extends in a flat plane, at the level of the upper surface of the sidewalls of the boat, and continuously, from bow to stern. As a consequence, substantially all water which hits the deck flows over the outer edge of the upper deck at the side opposite that from which the water approaches the boat, and not into the lower deck and into a "catch basin" area as is so common in boats as before constructed. Thus, the possibility of my boat, as so constructed, being "swamped" is non-existent, since substantially all of such water flows across the deck and returns to the original body of water from which it originated.

The upper deck of my boat is continuous because the only lack of continuity which exists is provided by the very minimum of space existent between the covers of the hatches, which constitute a major portion of my upper deck. The interior of the fixed hatches is used for the storage of supplies and any other items which the passengers do not wish to retain in their immediate possession. Any seepage is disposed of by the bilge pump, a common item beneath the lower deck of substantially all boats. The only seepage which occurs is that which makes its way into the lower deck is by passing between the close-fitting hatch covers, or between the edge of the deck opening and an adjacent hatch cover. The cover and the openings are closely fitted to preclude any substantial seepage.

A second important feature of my boat is the provision and disposition of a plurality of swingably mounted swing chairs over the upper surfaces of the opposite sidewalls of the boat. The swingable mounting of these chairs enables the operator to clear the deck, except for the passengers, if he so desires, and thereby make room for activity. In addition, the strong high railings of my improved boat, which extend along the length of the boat above its sidewalls, provide a strong measure of safety by preventing passengers from being washed overboard in the event of heavy waters, and stumbling over something and falling overboard.

The swingable mounting of the chairs of my boat is unique in that it includes a swing mounting at the outer and inner ends of the swingable frame. Since the inner end of the swingable frame is locked firmly in one position on the axis pivot of the support pedestal the axis of the seat support swing arm at the outer distal end of the frame must go with any movement introduced in the boat by the strong wave vector. The axis pin of the inertia control swing system under the seat introduces no torque to the situation, it just must go with the boat. The seat is a different matter, in that the pin under it is disposed near the front end of the seat, and therefore, the front end of the seat must go in whatever direction the violent vector of the wave pushes the boat, but, the center of the seat, the back of the seat and the person sitting in the seat are a different matter. Their weight center is away from the pin by approximately 4 inches, and since the seat is most likely faced in any other direction than that the violent vector is going, a torque or twisting effect takes place, instantly. The pin drags the front of the seat, "down wind", so to speak, and the off center mass, regardless of its inertia, must follow. The inertia of the seat and its occupant causes the front part of the seat to swing with the movement of the pin at the front of the chair, which brings the outside back of the chair into a position facing the power vector and the occupant facing in the direction in which the vector is moving. The inertia of the occupant's body holds the occupant within the confines of the chair, which saves lives.

My new boat has many new safety and convenience features. The provision of a deck which is clear except for passengers, is a vast improvement in that it substantially reduces or eliminates confusion, inconvenience, and possible injuries, and even deaths, which are much more likely to be experienced in a small boat of prior construction. The disposition of an upper deck at a level abreast of the upper surfaces of the sidewalls of the boat is a marked safety feature, in that it is impossible to swamp my new boat. This is true because almost all of any water which is directed toward the interior of my boat is shed by my upper deck, for the simple reason that the water has no free access to the boat's interior. Consequently, it is caused to run off the deck and back into the source from which it originated. Also, my boat is much more convenient, enjoyable, and safer than prior boats because there is much more room, no baggage or other objects to trip over, etc., since all supplies and other objects are disposed within the hatches under hatch covers. The covers have conforming outer edges which cooperate with each other and the opening-defined edges of the upper deck to present a substantially continuous, seepage-less surface to any on-coming water.

Another feature of my invention is the positioning of swinging chairs, with seats for humans which are pivotally mounted at and along the sidewalls of the boat, capable of being swung to a position outward of the sidewalls of the boat. The reason for this varies. Generally the frames of the swing chairs are locked so that they are directly in toward the center of the boat. This is the 90 degree setting as viewed in FIG. 20, and since the long swing frame can no longer move on its support pedestal, it is solidly set in its position just as much as if it had a pedestal down directly from the center of the seat. This is fine for riding around and traveling from one place to another, however, when the boat finally gets to the place where the passengers want to do something, such as cast for fish, or move around the boat for any reason, they often don't want the seat in the way. The solution to that is easy, as all they need to do is pull the locking pin out from the pivot axis of the support pedestal and the swing frame is free to swing. Then, if they just want to move the seat a short distance on deck to give them a place to stand where the seat used to be while traveling, they push the seat forward or rearward, out of the way. If, however, they don't want the chair close, at all, they just manually swing the seat out over the sidewall area or swing it all the way out of the boat, which stores it out over the water, resting, as it awaits the passenger wanting it aboard again for his seating pleasure. Flexibility is the key.

A further advantageous feature is the use of a swinging frame to pivotally support similar chairs to facilitate movement and comfort of the occupant of the chair while entirely clearing the deck, except for the drivers console or helm and the driver.

Another everyday advantage of my swing seat system is the life saving inertia control swing arm system located under the commercially purchased padded seats with arms as it rides the distal end of my locked swing frame. The high powered motor that thrusts the boat forward and up on plane can be used to show and explain how the inertia control system reacts to any violent incoming vector that is powerful enough to forcibly move the boat. The inertia of the passenger and the seat he is riding in is used to save his life and provide everyday comfort. Using the boats own power to prove the efficacy of the inertia control system makes sense because this is power we have at hand. In brief, the pin at the axis end of the under seat swing arm plate system causes a twist-swing effect which makes the seat and passenger in it, turn and follow the path that the pin is forced to take by the hole at the outer distal end of the swing frame, as the boat changes movement. More about this is explained in the Detailed Description of the Invention.

One surprising extra advantage from the unique high railings is the fact that railings run parallel to and directly above the side edges of the boat, and are also equidistant at each of their ends from the boat edge top surfaces. This means that rectangular paneling or canvas may be fastened to the railing above and the deck edge below. The paneling will do several things, act as spray buffer, child safety containment and surface for placing advertising message or decoration.

The purposes of my invention is to benefit the world by showing the advantages achieved by using my Ride on Principle, which is simply that for the small, (Under 26 feet in length), open power planing boat it is much more efficient, safe and full of joy for the passengers to ride up on top of a completely flat top deck and keep their supplies below water tight hatches while using my BOAT WITH SWING SEATING high railings. Actually, I am revolutionizing the Marine Industry on this matter. I teach that the Prior Art is wasteful in life loss, injury and joyful action for the whole family.

Each of the above features, as well as more limited features set forth hereinafter, are believed to be new and are known to be beneficial in the light of my past experience with boats, which has been substantial. These features described above, alone and in combination with each other, are different and beneficial to a substantial degree over boats of the prior art, as pointed out and claimed herein.

BRIEF DESCRIPTION OF THE DRAWINGS

A detailed description of the preferred embodiments of my invention, "Boat with swing seating" is hereby described with specific reference to the drawings.

DETAILED DESCRIPTION OF THE INVENTION

Figure 1:
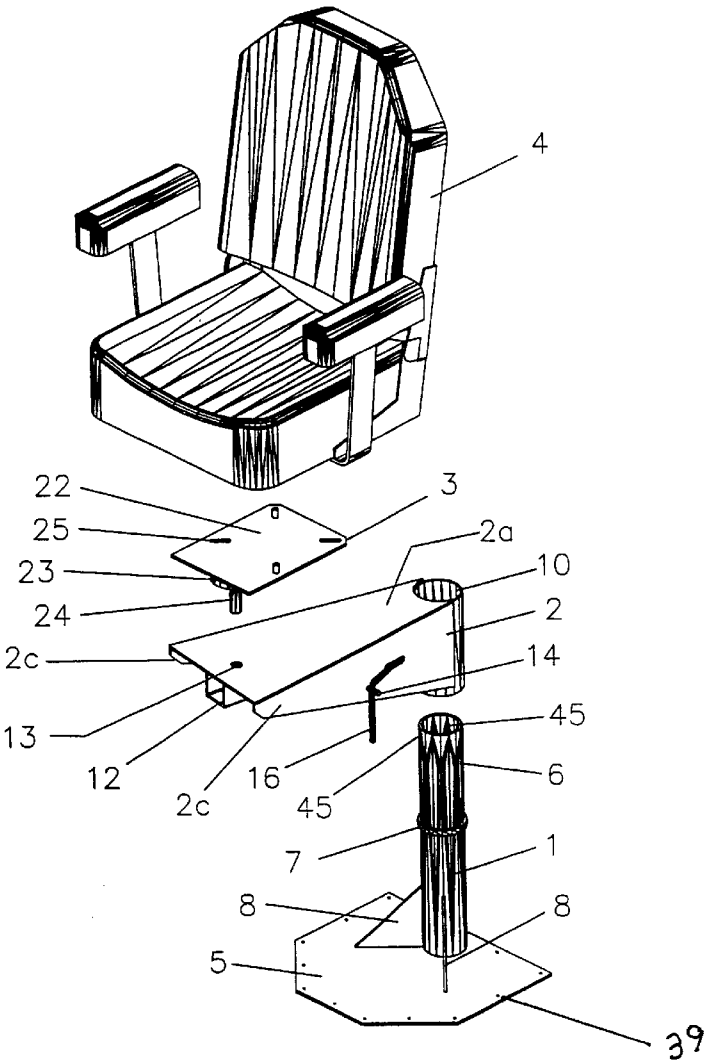
FIG. 1 is an exploded view of my swing chair.

My invention as shown in FIGS. 1–24C, inclusive, includes a number of novel features, the incorporation of which in a boat has already proved to have substantial merit. As shown in FIGS. 9–15, inclusive, my boat includes a hull 26 having a bow 37 and stern 38. It includes a lower deck 36 and floatation material 35 there below. The hull 26 has opposite sidewalls 41 and 42 which have upper surfaces 41*a* and 42*a*.

It also includes an upper deck 43 which is flat and extends between the sidewalls at a level with the upper surfaces 41*a* and 42*a*, from sidewall 41 to sidewall 42 and from bow 37 to stern 38. As shown, it has an opening 44 therein which is substantially closed off with a plurality of hatches 28, the covers of which are configured to closely match the opening edges 44*a* and thereby preclude the entry of water into the opening and interior area beneath said opening. As a consequence, the hatch 28 covers, as shown in combination with the remainder of the upper deck 43, the entire interior of the hull 26, above and at the level of the upper surface of sidewalls, effectively sheds off the vast majority of the water which may reach the upper deck in the form of waves or precipitation. Thus it is impossible for my above boat to swamp since the bilge pump, which is universally a part of a small motorized boat, will easily dispose of any and all seepage water that may occur.

Figure 17:
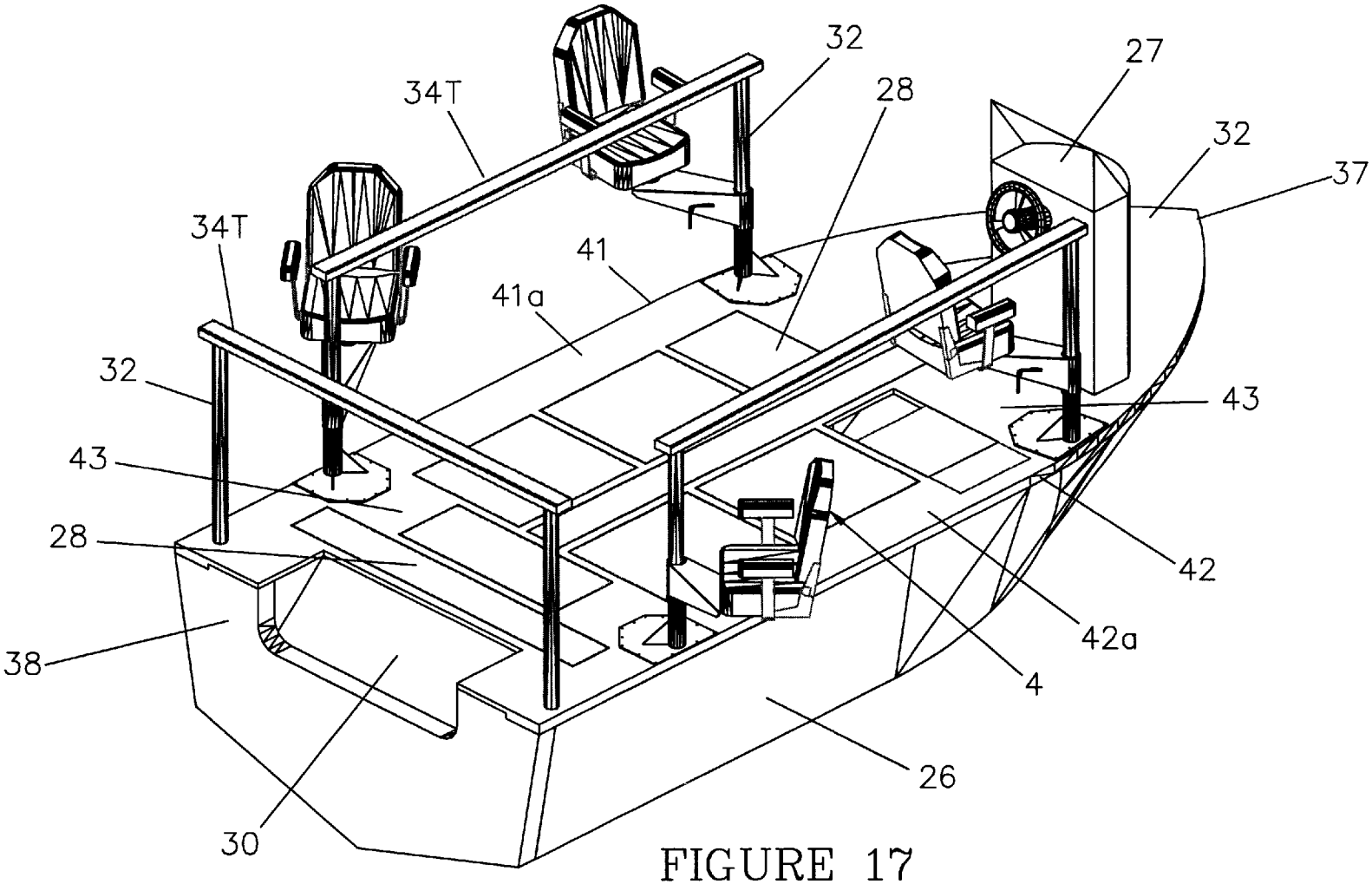
FIG. 17 is a perspective view of my planing hull invention, taken from above and behind the hull, the chair pedestals being mounted on the upper deck so that their base plates are fastened broadside edge to the very edge of the top flat deck.

I have found it absolutely necessary to dispose the upper deck at an absolute level with the upper surfaces of 41*a* and 42*a* of the sidewalls 41, 42 inclusive of the hull, FIG. 17.

Figure 16:
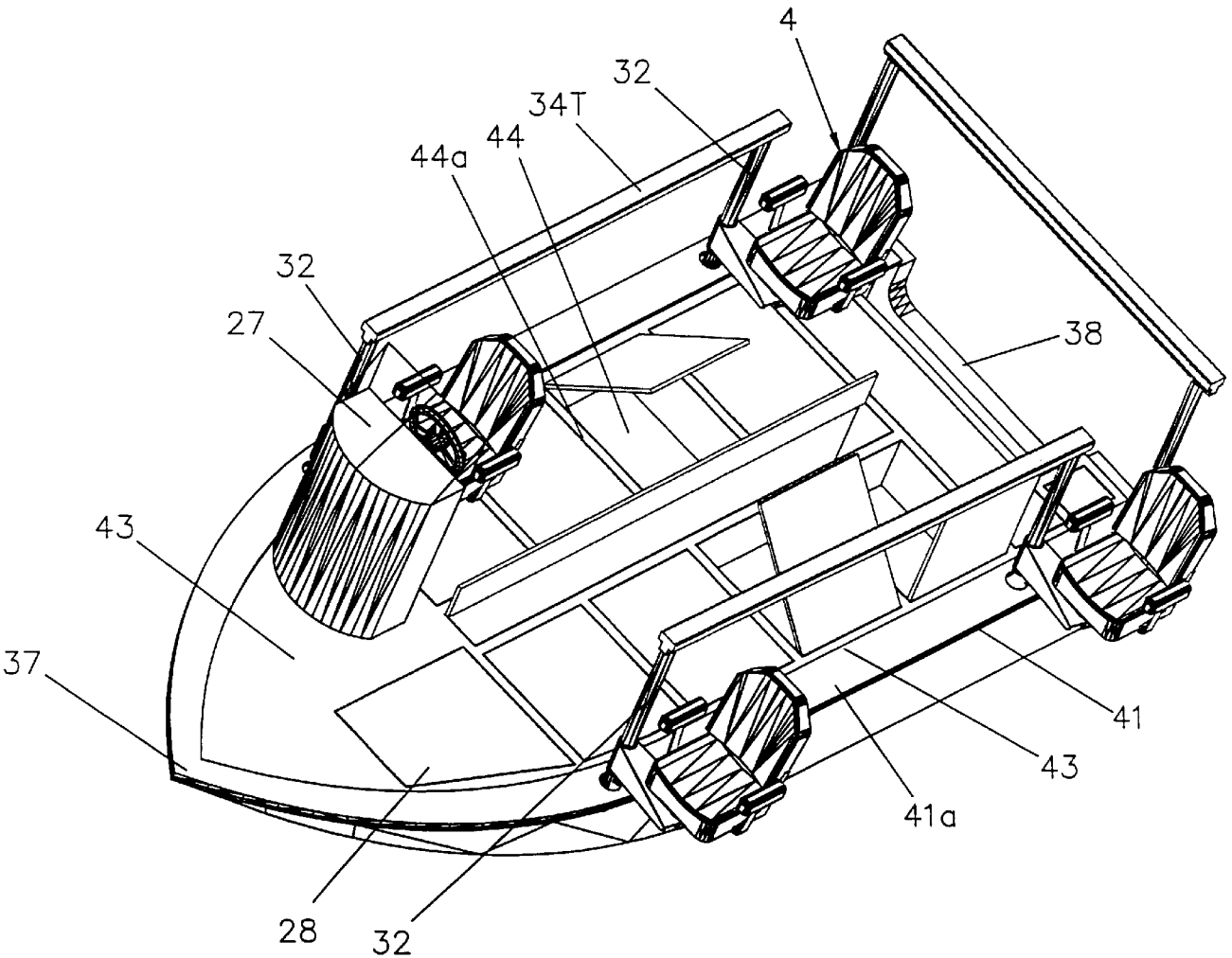
FIG. 16 is a perspective view of my invention, taken from above and ahead of the hull; the chair pedestals being mounted in the upper surface of the hull sidewalls.

FIGS. 16 and 17 each show a pair of swinging chair seats 4 pivotally mounted at or along the upper surfaces of the sidewalls 41 and 42, one pair at the bow area of the sidewalls and the other pair at the stern area. Each of the chairs 4 are of the type commercially available on the market but their mountings include a pair of vertical axis pivots, as best shown in FIGS. 1–8, inclusive. It might be best understood if one considers the vertical pedestal axis about which the swing frame 2 moves as the controller of the relative place in or about the boat that the seat 4 will end up being located. This is because seat 4, bolted to its swing arm plate 22 FIG. 8, which is plugged by its own retained axis pivot pin 24 into hole 13 at the distal end of swing frame 2 and will sit out there at the distal end of the swing radius exactly where the hole 9 of pedestal 1 or 1*x* demands when occupied by the locking pin 16 FIG. 5. Furthermore, this location control axis is at the center of the 360 degree circle that the swing frame 2 travels and since the distance from this center to the distal end of the swing radius is 18 and ½ inches the diameter of this circle of travel is approximately 37 inches.

Prior art has devised vertical axes systems but, none like mine and they cannot do the aggregate job that is done on the BOAT WITH SWING SEATING. Richard W. Conant has produced three vertical axes 80, 120 and 140, of his FIG. 2, but none are like mine. He has one vertical powered axis that can travel the lower arm two ways from a center line of 120 degrees each way, a total of 240 degrees and this axis is mounted to the deck in the center area of the aft fishing cockpit of a cruiser. He has another axis that totals a possible power travel of 180 degrees. None of these axes is hollow so that the center can be used for another purpose. He has another axis at the distal end of one arm which is directly under the center of a fisherman's chair that can travel a full 360 degrees. This is simply a pivot pin axis from below upon which the seat and its bearings can be spun just like a wheel on its axle.

In contrast, my use of axes is entirely different; my seats 4 do not have an axis of pivot directly under the center of the seat as all prior art pedestal seats do. My commercially purchased seat 4 is center mounted near the distal end 3 of swing arm 22 FIG. 1 by screws or bolts through the slots 25 and the seat having a forward side and a backward is aligned so that the forward side is directly over pin 24 and the backward side extends out over the distal end 3, which means that the heavy weight of the passenger presses down hard on the distal end of 22 and not much over pin 24. Since the pin 24 is imbedded deep in hole 13 of swing frame 2 FIG. 1 the front of the seat 4 must go instantly any where hole 13 is forced to go by the locked in position of swing frame 2. This means that the inertia of the passenger's heavy body, being out away from the pivot point, will force the seat to twist and face away from the incoming vector and in the process it catches the body between the arms and brings it along. High speed sequence photos have been made of this action and are available for study.

The Boat with Swing Seating always uses a minimum of four (4) swing seats for the simple reason that seating is needed and the upright pedestals 1 or 1*x* are a must in order to support and hold firm the necessary high strong railings on both side edges of the boat. Choice of two of my pedestals are used. Pedestal 1 has a base plate 5 which fastens conventionally to the very side edge of the boat FIG. 17, and pedestal 1*x* which is imbedded down into the side edges of the boat 31 FIG. 10 and FIGS. 20 and 21. The axis areas of each pedestal, section 6, has no moving parts. Each pedestal has, in the section 6 area eight (8) strategically located holes intended to be used by the locking pin 16 FIGS. 4, 5 and 6 inclusive when the rider chooses to locate his seat in a certain spot in relation to the boat. The swing arms, 2 and 22 are each able to freely travel swing a full 360 degrees. If 2 is locked, arm 22 can still swing at the distal end of swing frame 2 FIG. 5. Hole 13 encompasses the pin 24 as bushing 23 of swing arm plate 22 FIG. 8 rides the distal end of plate 2*a* of swing frame 2. Meanwhile, seat 4 bolted through slots 25 out at the distal end of swing arm plate 22, rests quietly. Rotational wise, seat 4 only turns under manual or inertial impetus, but its location in the boat is governed by its hole 13 relative to the hull. Note should be taken, at this time, to the fact that arm plate 22 is actually a swing frame swinging around its axis of pivot 24, which is a solid steel round, just as swing frame 2 swings around its axes pedestals 1 and 1*x*. The distal end of swing arm 22 is edge 3 shown in FIG. 1 but the effective distal end is the back side of chair 4 which adds to the inertial load that drives the turning of pivot pin 24. It is this offset centering of swing arm 22 that forces the inertia of the passenger's own body to swing the seat so that it faces away from the path direction of any horizontal violent vector that throws the boat about. It is possible to prove this effect by making use of the boats own powerful motor.

Realization should take place that the open tubular members within the pedestals 1 and 1*x* support and hold vertical the posts 32 which are fastened firmly by tight grip T-bar post caps to the railings 34*t* FIGS. 16, 17, 18, 19, 20, and 22 inclusive, as all are part and parcel to the boat with swing seating.

Realization should take place that if the locking pin 16 is allowed to be pressed into hole 9 by spring 18 of swing frame 2 there is no longer a swing seat situation in relation to the boat. The swing frame is fused solid to its upright support pedestal, 1 or 1*x*. The seat 4 location, relative to the boat, is in one place in the boat, just as it would be if it were mounted, as the prior art seats are, that have their pedestals directly under them and are fastened to the deck below, or their pedestals that go down through the top deck and are fastened below in the hold. Each of the chairs 4 can be turned manually 360 degrees there at the distal end of swing frame 2. This is so the rider can face his seat any direction he wishes while quietly fishing or doing other work on location. In fact, he can do this seat swinging whether his swing frame 2 is locked or unlocked on its vertical axis pedestal 1 as in FIG. 17 or on its vertical axis pedestal 1*x* as in FIG. 20 or 21 inclusive. At this time, one thing should be made very clear. The passenger is not pivoting the seat, as he would be doing when changing the facing of the seat in all pedestal seats, of prior art. In said prior art, all mechanisms for fastening to whatever for ease of turning the seat, placed the pivot point directly in the center of the seat base mass. My life saving inertia control swing plate 22 FIGS. 1, 7 and 8, inclusive, does not work in the said prior art way. My swing plate 22 does have a pin 24 FIG. 8 that goes downward through hole 13 at the distal end of frame 2. Pin 24 does pivot. But, since it is located approximately 4 inches away from the center of mass and base of seat 4 the center of mass, of the passenger, the seat 4 and the base plate 22, all swing, not pivot.

In addition, my seats 4 are offset from their pedestal axis center by more than 18 and ½ inches which means they swing in a circle of more than 37 inches. Also, it is plain to see that beneath the seats 4 the deck 43 is completely clear and open for use of any kind wanted, lunch box, tackle box or whatever. Contrariwise, prior art uses that space for pedestals or box work. You can put some stuff in box work but it still takes more space and cuts out any possible hatch covers.

Figure 3:
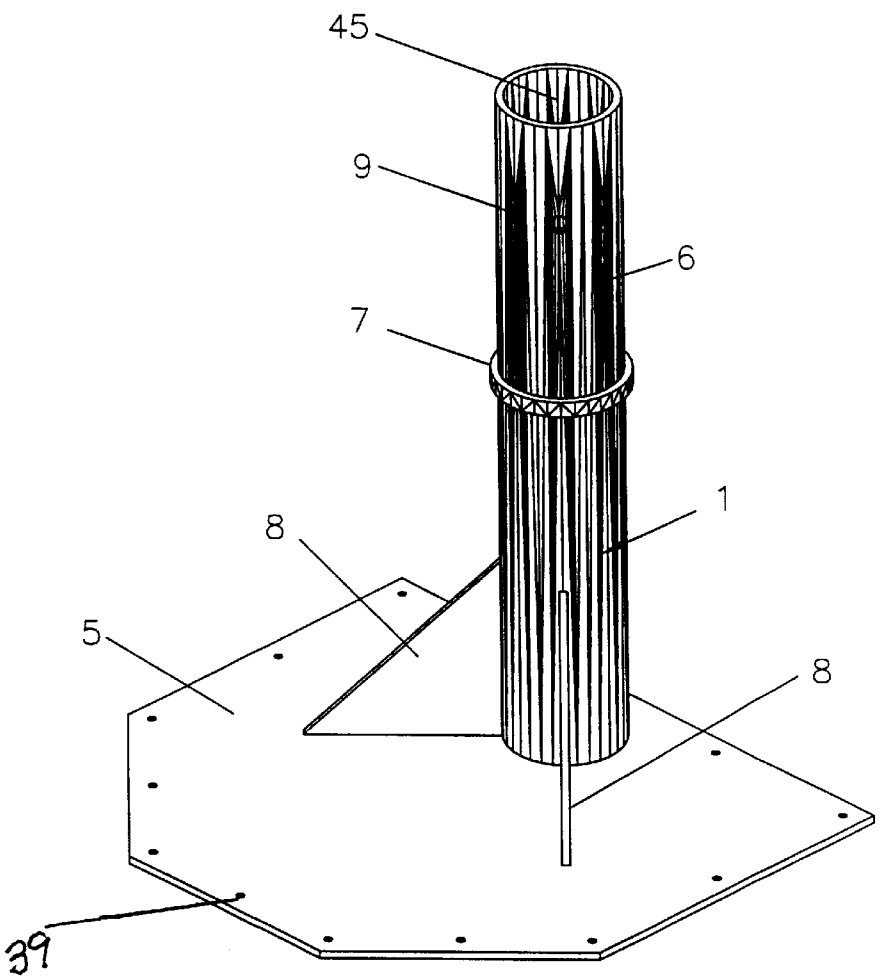
FIG. 3 is a prospective view of my pedestal shown in FIG. 2.

The mounting for each of said chairs 4 includes either an opening in the sidewall 31 FIG. 10 using a pedestal 1*x* FIGS. 20 and 21 or a pedestal 1 FIG. 3 with its base plate 5, the later of which is designed to be fixedly secured to a top deck 43, FIG. 17. Both said pedestals are non-rotational, with two holes 9 directly over the sidewall. The technology holding 1*x* non rotational is below deck, and is not shown. Fixedly secured to the upper surface of the plate 5 as by welding is an upstanding metal tube which constitutes the pedestal 1, which is supported by a pair of gussets 8 which extend from the tube toward the front of the base plate 5 and are disposed at an angle of approximately 60–90 degrees to each other. The base plate 5, is secured to the top deck in any conventional manner, as shown in FIG. 17, with the angled portion extended away from the adjacent sidewall and its straight base portion extending parallel to and along the edge of said sidewall. The mounting for each of the chairs upon the upper surface of the sidewalls of the boat, as shown in FIG. 16 is accomplished by utilizing a somewhat longer pedestal 1*x* which extends downwardly into an opening in the sidewall provided at the lower end of the pedestal and within the sidewall as shown in FIG. 21. The swing frame 2 is shown in the exploded view of the chairs 4 and their mountings in FIG. 1, and as shown, includes a vertical cylinder 10 which fits over the metal tubular section 6 of pedestal 1, the bottom edge of which rests and swings on bushing 7. Bushing 7 is welded the proper distance from the top of pedestals 1 and 1*x* so that the top of cylinder 10 will smoothly conjuncture evenly with the top of the pedestal 1 or 1*x* and so that the holes 9 of the pedestals will conjuncture exactly with the locking pin 16 when presented. Tubular section 6 is that axis area of the pedestals that cylinder 10 encompasses, travels and rests on. Both pedestals are long and strong and made from the same pipe stock (Schedule 40).

Figure 8:
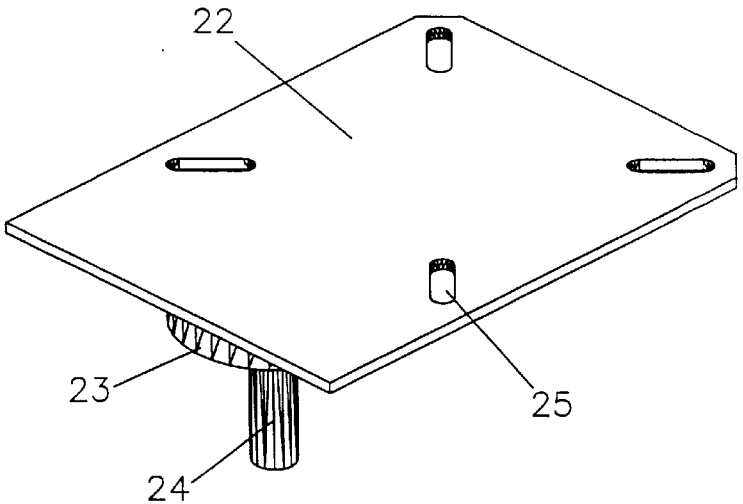
FIG. 8 is a perspective view of the inertia control swing travel arm, as seen from above.
Figure 7:
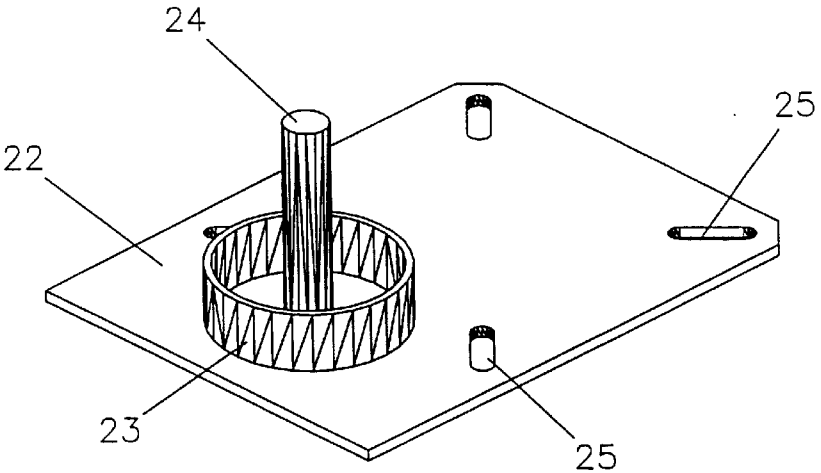
FIG. 7 is a perspective view of the inverted inertia control swing travel arm with its axis pin and bushing as seen from below, and note how the commercial seat mounting slots are not beneath the axis pin. This is not a seat pivot as of yore.

The swing frame 2 as shown in FIG. 1, includes a radially outwardly extending flat horizontal platform 2*a* which is adequately supported by a pair of support plates or brackets 2*b* and 2*c*. The horizontal platform 2*a* has a metal tube 12 of small rectangular cross-section welded to the outer extremity and under surface of the platform 2*a*. A pivot hole 13 extends downwardly through the outer end of the platform 2*a* and through the upper and lower wall of the metal tube 12 to accommodate the reception of pivot pin 24, which is shown in FIGS. 7 and 8.

Figure 2:
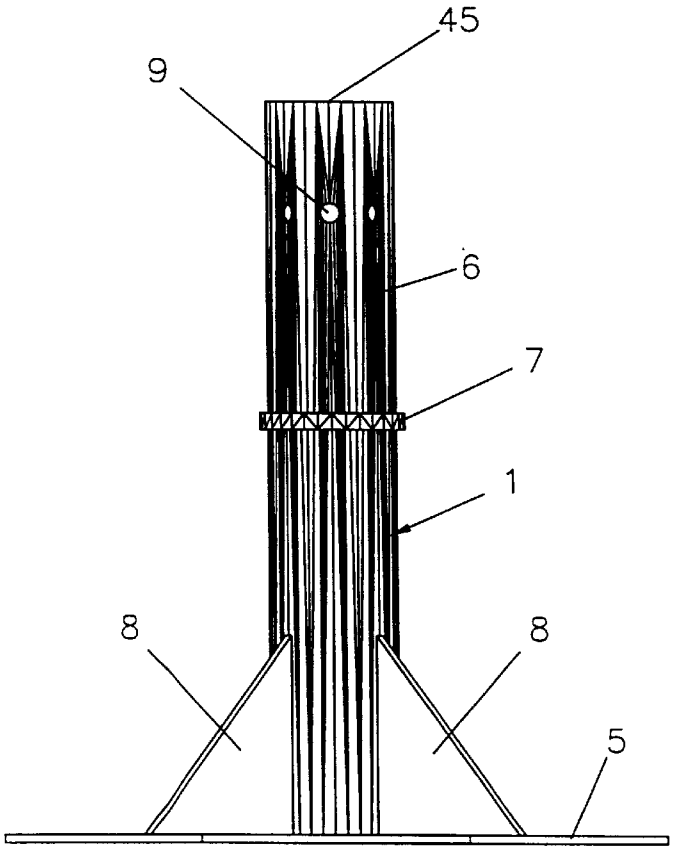
FIG. 2 is a front elevation view of my off-set pedestal about which my swing chair swings.
Figure 4:
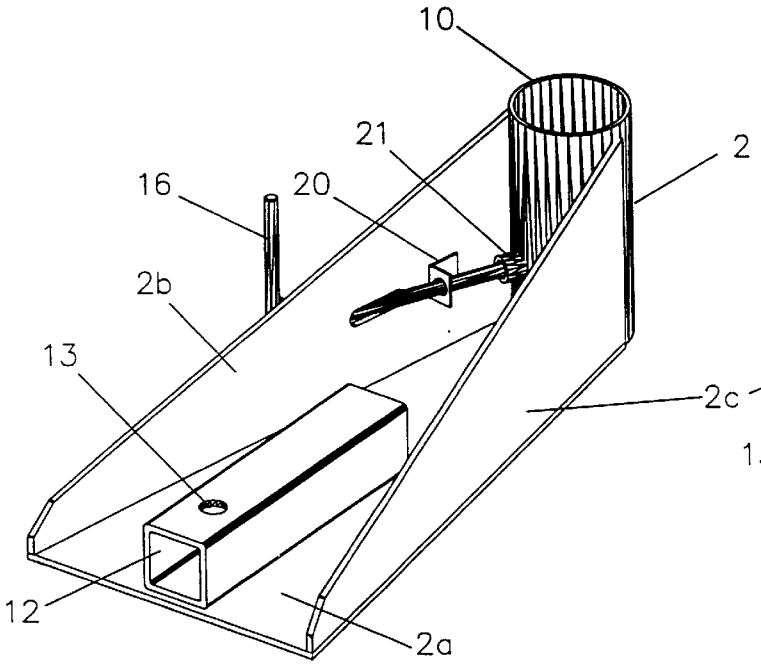
FIG. 4 is a perspective view of the swinging frame of my invention, which swings about the pedestal shown in FIGS. 1 and 2, shown in inverted position.
Figure 6:
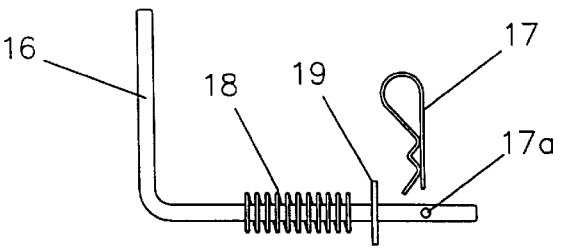
FIG. 6 is a side elevation view of the swinging frame locking pin in isolated position apart from the frame.

The swing frame 2 includes a locking pin 16 shown in FIG. 4, which carries a spring 18, a washer 19 and a cotter key 17 and extends through an opening provided therefor through the support plate 2*b* and locking pin supporting bracket 20. The spring 18 is arranged and functions in the conventional manner to constantly urge the locking pin 16 inwardly through the bushing 21 and the wall of cylinder 10, to engage one of the eight (8) holes 9 which extend through the upper end of pedestal section 6, as shown in FIG. 2. Retaining post 14 FIG. 5 functions to hold locking pin 16 in retracted position, when desired, and is utilized only when the chair occupant desires free swinging thereof about the section 6 on either pedestals 1 or 1*x*. The bushing 7 functions to facilitate such movement. It should be pointed out here, that post 14 will not permit the pin 16 from falling out of hole 9 even if spring 18 should fail. Furthermore, the handhold part of the 90 degree bent locking pin 16 is held down by gravity and vibration so that the pulling out of locking pin 16 from hole 9 is only accomplished by raising the hand hold part up over post 14 and pulling it out against the pressure of spring 18 and this is important, as all high-speed riding should be done only with the swing frame locked tight to its pedestal.

As shown in FIG. 1, pivot pin 24 extends into opening 13 so that pivot pin plate 22 can swing about the longitudinal axis of pivot pin 24, and goes downwardly into and through metal tube 12 to provide a non-tipping or rocking hold on pivot pin 24 as plate 22 swings about the longitudinal axis of pivot pin 24. Bushing 23 extends between platform 2*a* and pivot pin plate 22 to facilitate rotation of pivot pin 24 and chair 4 which is fixedly mounted at its underside upon pivot plate 22 via slots 25 in any conventional manner. Bushing 23, FIG. 7 and 8, extends between inertia control plate 22 and 2*a* the top of swing frame 2 to act as bushing for axis pivot 24 and as a spreader of at least one inch of space between the bottom of chair 4 and the smooth top of deck 2*a*. This space is necessary because the metal arm rest forms bend around and are fastened beneath the chair bottom, and these bent metal forms stick down from the bottom of the chair by at least ¼ inch, and maybe more, as chair 4 is fixedly mounted at its under side upon swing plate 22 via slots 25 in any conventional manner. It will be noted, however, that pivot pin 24 is located adjacent one end of inertia control swing plate 22 as shown in FIGS. 7 and 8 and the top side of said swing plate 22 as shown in FIG. 8 is secured to the bottom surface of each chair 4 so that pivot pin 24 is disposed beneath the front of the chair. As a direct consequence, each chair 4 swings about a vertical axis extending down from the front portion of the seat of the chair. That axis of pivot is disposed at the distal outer end of platform 2*a* which enables a chair occupant to swing about pedestal 1 and also swing about the axis of pivot pin 24 encompassed by hole 13 of frame deck 2*a*. Each of the four (4) chairs are similarly mounted for movement about the vertical axis of the pivot structure provided by pedestal 1 and swing frame 2.

Figure 19:
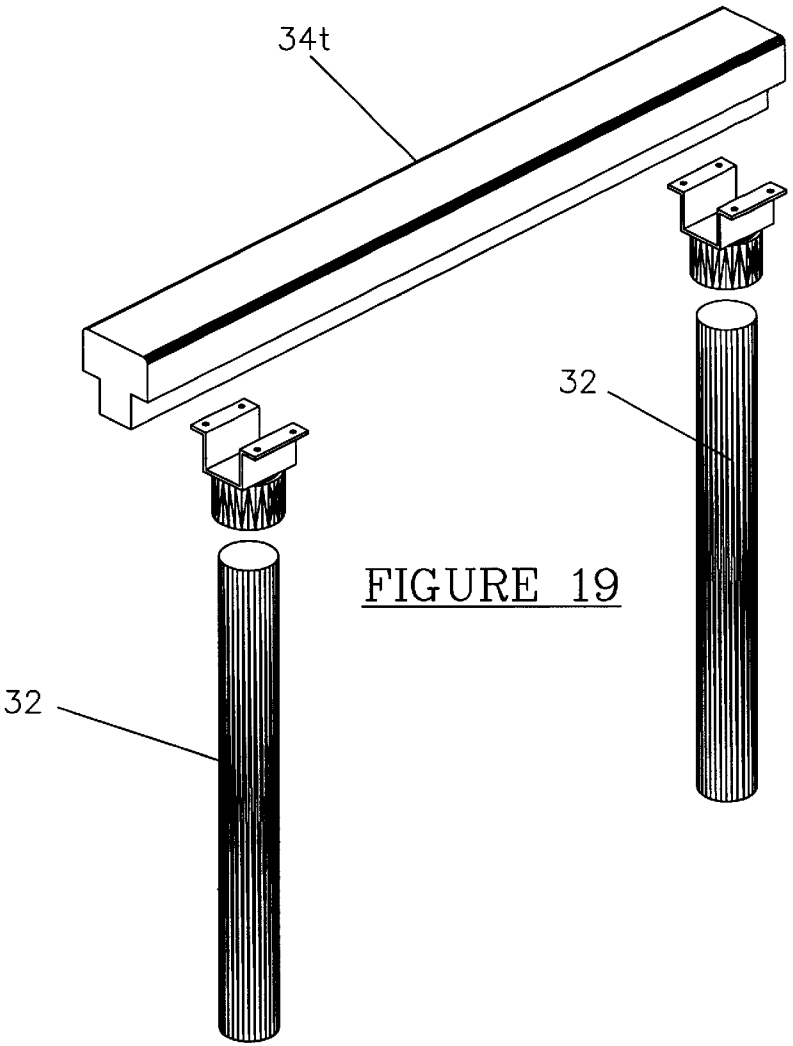
FIG. 19 is an exploded view of the T-bar caps, the eight sided (surfaces) T-bar Railing and the posts that go into the tubular center of the axis support pedestals of my swing chairs, the later, not being shown.
Figure 18:
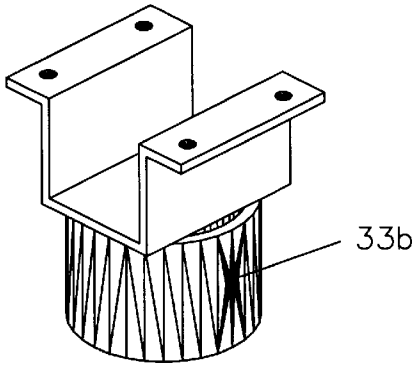
FIG. 18 is a perspective view of the T-bar caps used to fasten the T-bar railings to the posts held by the long tubular member within the support pedestal axis of my swing seats.

It will be noted that the upper ends of each pedestal section 6 would be open were it not for their use as mountings for the side rails 34*t* as shown in FIGS. 16 and 17. This can best be appreciated by reference to FIG. 1, wherein the upper end of cylinder 10 and pedestal 1 are open. This opening is character number 45. It is the whole inside tubular dimension of the pedestals 1 and 1*x* and is of 2 and ½ inch diameter. In pedestal 1 it is 16 and ½ inches deep with a ¾ inch hole in base 5 to which it is fixedly welded, and this hole is to provide access or egress with the below top deck interior. The hole in plate 5 is not shown. In pedestal 1*x*, shown in FIGS. 16 and 21 the access or egress pathway 45 to the interior is much longer and the action below the side edge tops 41*a* and 42*a*, not shown. As is evident in all of the boat drawings showing railings we see the railings being supported by posts 32, FIG. 10 shows openings 31 in the sidewalls, in which the pedestals 1*x* are inserted. We see by the drawings that the posts 32 FIGS. 17 and 19 support the rails. All my boats have flat top decks 43 as shown in FIG. 17. The bases 5 FIGS. 1, 2 and 3 are mounted with the long sides of these unique bases directly over and aligned parallel with the fore and aft line of the side edges and fastened in any of several convention ways to the top edge surfaces 41*a* and 42*a* which are perfectly level with the top deck 43. Rail posts 32 are inserted in the openings 45 of the upright pedestal 1 FIGS. 1, 2 and 3. Tubular member 10 of swing frame 2 FIG. 5 goes, right side up, on the section 6 of the axis pedestal 1 before mounting the tight grip post caps 33*b* as shown in FIG. 18. They are fixedly fastened to the posts 32. These posts 32 FIG. 19 are made of wood and encapsulated in PVC and are inserted in close-fitting relation in the otherwise open end 45 of the pedestal section 6. Then, a railing 34*t* FIGS. 19 and 23*b* extended between and fixedly secured at its end portions to grip tight T-bar post caps 33*b* FIG. 18 located in forward and rearward positions, at each side of the boat. Thus the side railings 34*t* are mounted in a most effective protective position. Each side railing is approximately 37 inches high, which is a most effectively protective position.

My boat, as described above, has substantial advantages. The adoption and usage of an upper deck at a level absolutely even with the upper surfaces of the sidewalls of a small boat, so as to make same incapable of being swamped, greatly increases the safety of the boat, as well as the enjoyment and comfort of its use. It provides a substantial increase in the enjoyment of the boat, since it multiplies the space available for the usage by the passengers many fold. It effectively precludes sinking of the boat, with or without passengers. It substantially increases the amount of space made available to its passengers. It insures that substantially all of the water which strikes the area in which the passengers are located will be shed across its upper surface and discharged at the side of the boat opposite from which it approached the boat.

Figure 20:
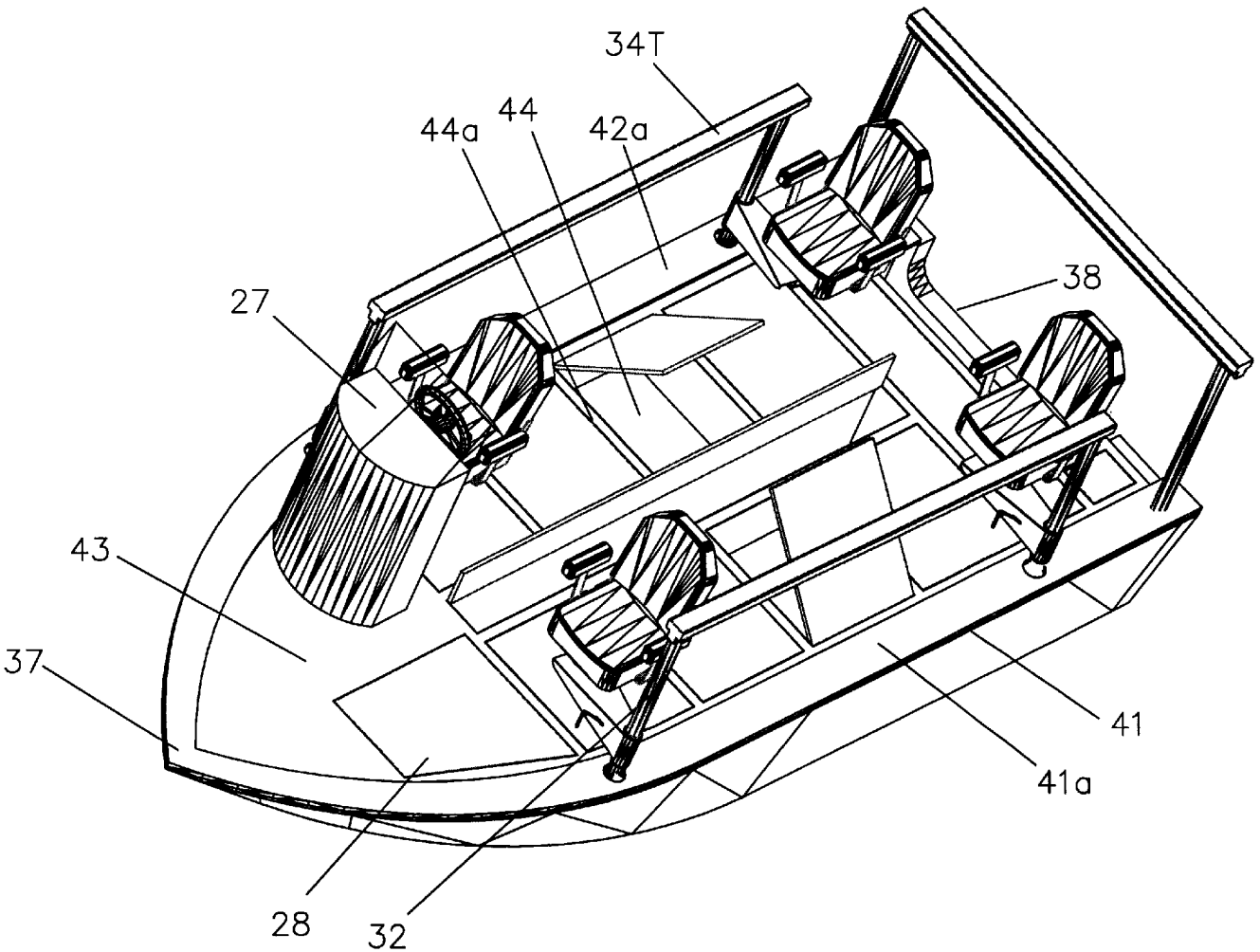
FIG. 20 is a prospective view of my invention, taken from above and ahead of the hull, the chair pedestals being mounted deep in the sidewalls of the hull, base and fastenings, not shown. The seats are shown in the 90 degree position from the sidewalls.
Figure 21:
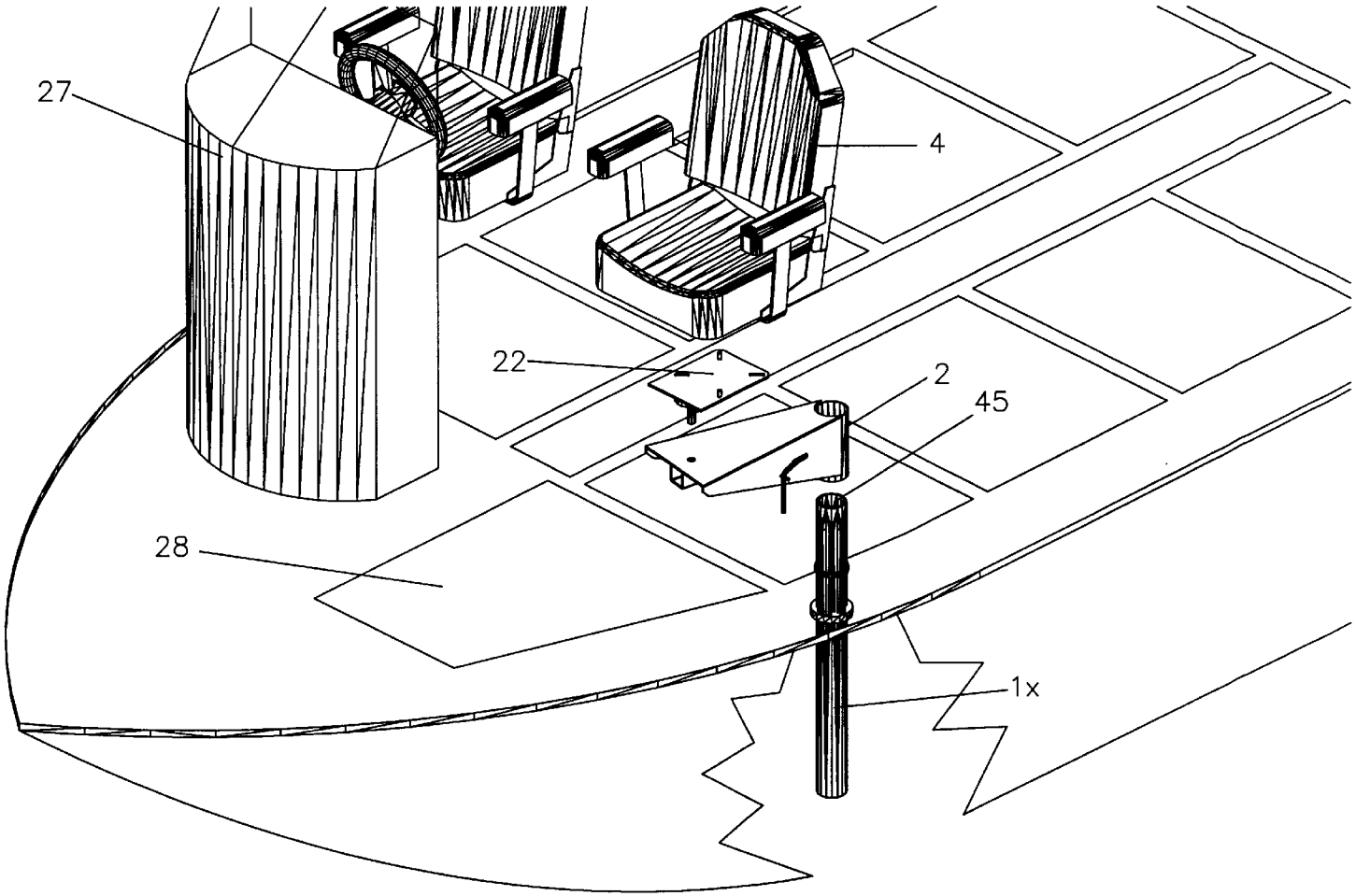
FIG. 21 is an exploded view of my swing chair system mounted directly in the sidewall, the base and anti rotation system of the pedestal axis is below deck, not show.

By insuring that substantially all of the water which hits the upper deck will run off the upper deck's upper surface, I have obviated the need for the area of small boats which have been designated as a "catch basin", by disposing all of the swing seating of passengers and the boat pilot with his instrument and steering control console up on top of my all inclusive flat deck 43 FIGS. 17 and 20. As a consequence, the ride is much more comfortable and safer in my boat, since my driver and his passengers cannot find himself or anyone else sitting in a well of water that cannot drain off. Furthermore, the driver, and all of his passengers, can see everything that is going on much better than if they were down in the below of a top deck well. That goes for whether or not the small power boats are sitting quietly or moving. While both boats are moving very slowly and staying in full water displacement condition the people on my boat will still see around much better than those in the other boat because they are sitting in seats that are at least 16 and ½ inches above the top deck 43. Then, as power is added to both boats, the bows of each boat starts to rise. Then, as power is added, the bow rise increases to the maximum difference in height between the bow and stern of each boat takes place, just before the boats go up on plane. It is this period of time in which the people in the RIDE-DOWN-IN-THE BOAT, prior art boats, are blinded by their own boat bows of everything that is out there before them. As the Coast Guard says, they must post a lookout forward. Conversely, all people riding on my invented boats, can see everything in all directions, regardless of speed. In very heavy weather, any pilot will raise his bow to the best inclined orientation that will get him home safely in as much comfort as possible.

The use of the pivotal mounting of the chairs adjacent to the front of the chair provides a valuable safety feature in that as a result of such mounting, lives are saved. This is due to the inertial reaction of the passenger's body mass, the chair 4's body mass and the swingable body mass of the plate 22 itself. When the boat is struck with a violent external force (resultant vector) of such magnitude that the inertia of the boat itself is overcome, the boat and everything in it, that is fastened tightly to it, will move in the direction of the vector. Since the swing frames of all of the chairs in the boat FIG. 20 are locked in the 90 degree position from the sidewalls, the holes 13, holding the pins 24 of the inertia control swing plates 22, which are fastened to the bottoms of the chairs 4, must travel too, in the direction of the vector. In such travel they take along the pins 24 and the front of the chairs 4. The aforesaid body masses, must comply and go along too, but not instantly, as the inertia of these masses forces the plate 22 system to twist and then follow the vector. In the process of doing so, the outside surface of the backs of the chairs will face the incoming vector and the passenger in between the arms of the chair will face forward away from the incoming vector. Of course, the incoming vector may be very harsh but of short duration, and in such a case, my inertial control will turn, just enough to catch the passenger before he falls onto the floor or out of the boat. Now, a manufactured proof of the validity and efficacy of my inertia control swing pivot can be done with the boats own power. First, take the boat shown in FIG. 20, making sure that the four swing frames are locked in the 90 degree position as shown, then, manually, face the seats toward the center of the boat, with or without people in them. Then, ask the pilot to advance the throttle quickly in order to bring the boat from its displacement position in the water up to a planing position on top of the water. The thrust necessary to do this, will be a vector from the rear that will force the seats, with or without occupancy, to turn smoothly and face forward, down the line of travel of the boat. The pilot may make any turns that he wishes and the seats will always follow the thrust (vector).

A short dissertation here on my inertia control system, how it is built and how it works, is called for. FIGS. 7 and 8 are the drawings of it. FIG. 8 is the right side up one, just as it fits and is bolted to the seat 4 through its slots 25. If you were to draw two intersecting lines that each went through two of the slots, the intersection would be the center point of the seat base that is bolted above it. That center point of the seat base, is approximately 4 inches away from the center point of the pin 24 which goes downwardly through hole 13 of swing frame 2. The center point of the seat base is also the center point of the mass, (the passenger) above it. Therefore, the only turning action of pin 24 is caused by manually turning the seat or by inertia acting on arm plate 22, the seat 4 and the passenger. Hole 13 provides location. The inertia of the passenger, acting at the distal end of swing arm plate 22 saves him.

Conversely, the dead center seat of the seat that was mounted, in prior art, directly and firmly to the deck is always thrust instantly in the line of travel of any large vector that is strong enough to jam the boat a foot or more. That thrust kicks the seat right out from under the sitter. The sitter can land in the boat and sustain injury or land completely out of the boat, it depends on the strength of the vector.

Further contribution to safety is provided by my boat by mounting side railings upon the sidewalls of the boat. By mounting side rails upon the pedestals, I have provided adequate protection for the passengers, against being washed overboard by unusually large waves. By utilizing the chair pedestals as mountings for the side rails, I have maximized the area available to he passengers of the boat for their freedom and comfort.

Figure 23B:
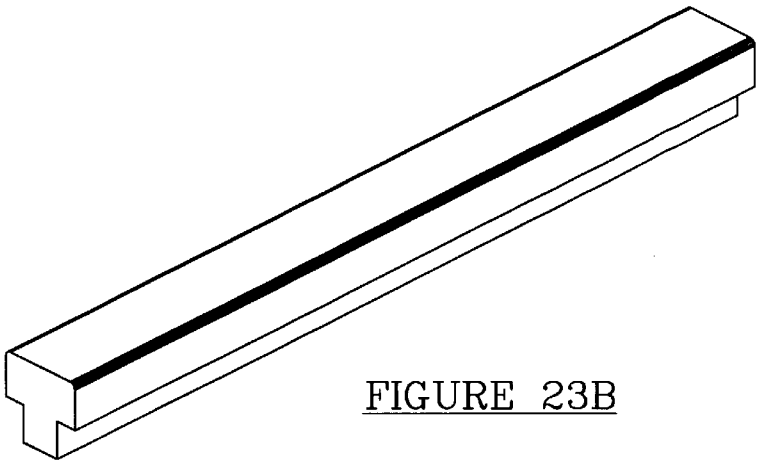
FIG. 23B is the ISO VIEW of the T-bar Rail.
Figure 23A:
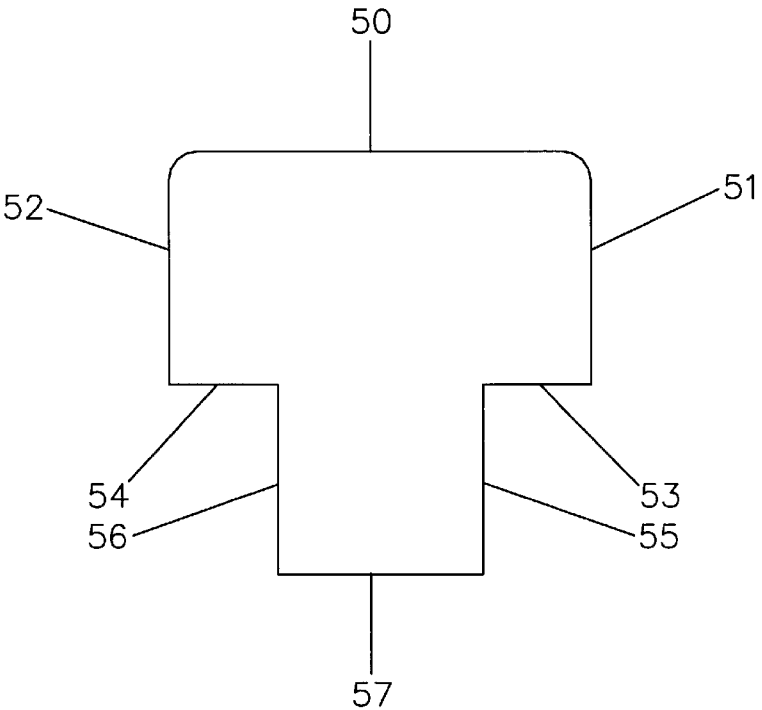
FIG. 23A is the Front View of the T-bar Rail.
Figure 24C:
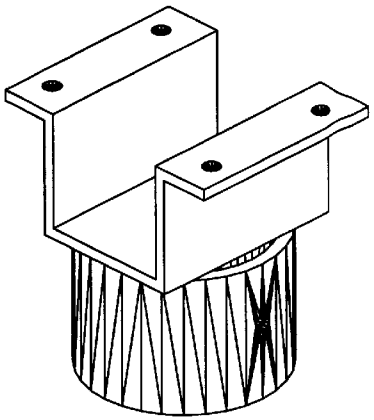
FIG. 24C is the ISO VIEW of the Grip Tight Post Cap.
Figure 24A:
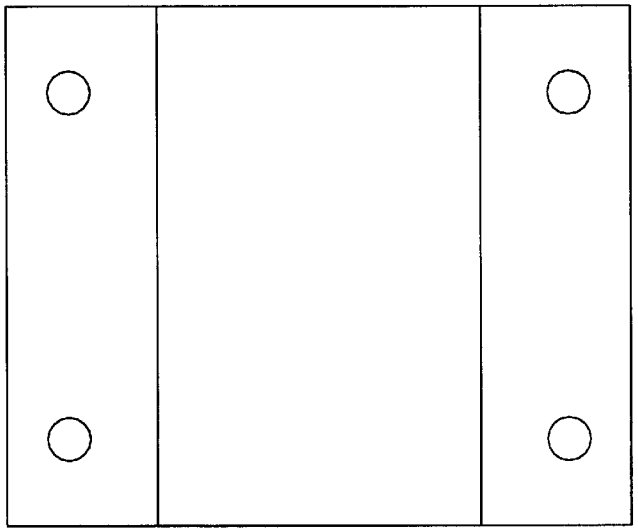
FIG. 24A is the Top View of the Grip Tight Post Cap.
Figure 24B:
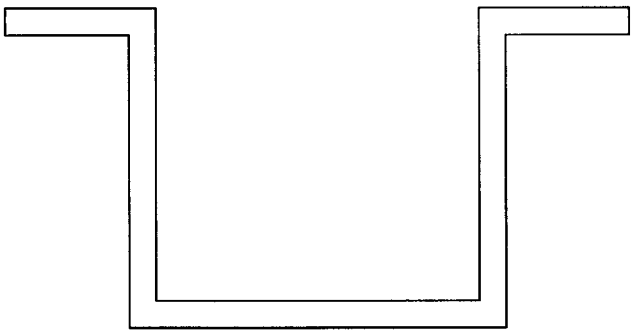
FIG. 24B is the Front View of the Grip Tight Post Cap.

A further contribution to safety is provided by my boat by mounting side rails 34*t* FIG. 19 and ISO VIEW FIG. 23*b* above the sidewalls of the boat. One of the unique features of my swing seating is that the pedestals have within them the large strong tubular members 45 FIGS. 1, 2 and 3, which strongly hold and support firmly the laminated posts 32 FIG. 19 shown on boats FIGS. 16 and 17. These posts are 32 inches long and they are fixedly fastened to the 34*t* railings by a unique grip hold fastener 33*b* FIG. 18 and they meet the T-bar railings 34*t* FIG. 19 in a tight fitted relation. This relation is unique in that the T-bar tight grip post cap is closely form fitted to grip firmly the two lower vertical surfaces, 56 and 55 and then be fastened conventionally to the two mid horizontal surfaces 53 and 54. They should be bolted first to the posts 32 and then to the 34*t* railing. The 34*t* railing has eight (8) running surfaces, each of which can be called on for certain needs. The front view of the rail, FIG. 23A shows the character numbers given to each surface. The top horizontal surface 50 is smooth, comfortble and safe for body support when reaching far overboard. The top vertical outboard surface 51 is in good position for common canvas or netting fastening. The mid horizontal outboard surface 53 is also good for common canvas or netting fastening. The lower vertical outboard surface 55 is good for fastening canvas, netting or panels. The bottom horizontal surface 57 is excellent to receive, hold and support heavy screw hooks and other common means of attachment. Life preservers and many other, need-to-be handy items, will go well there. The lower inboard vertical surface 56 handles hanging materials well too. The mid horizontal inboard surface 54 can be left bare or used. The top vertical inboard surface 52 should be kept smooth and bare.

Note, none of the preceding paragraph would be possible without the use of the unique big tubular member 45 which sleeps inside the pedestals 1 and 1*x*. This circular member has strong sidewalls, which are the same as the pedestals, but the inside of which is used to do the job of holding and supporting the posts 32. By using the inside and the outside of pedestals 1 and 1*x* I have managed to maximize the area available to the passengers of the boat for their freedom and comfort.

The position of the console and the drivers seat in the bow area are both contributions to safety in that they are located up on the deck 43 in the forward corner of the this effectively enlarged deck 43 area as mentioned in the preceding paragraph. Safety is achieved because of several things. One factor is that no one aboard can normally be in front of the driver and partially block his forward view. Another safety plus is that the driver sits high, 16 and ½ inches above deck 43, and thus, even if he puts his bow up to handle the wave situation, he can always see all around and forward. There is no such thing as bow rise blindness for him. There is little likelihood of his having a collision. That is left for the prior art.

The earlier mentioned increased space and flat deck top deck 43 is a big assist for my BOAT WITH SWING SEAT being used for police or EMT work. The clear wide open flat top deck 43 can provide the space and smoothness to lay a person out for resuscitation work. The holds can supply the carrying space for supplies and the railings are handy to hang whatever drip is needed.

It is noteworthy that each of the chairs 4 is capable of being swung outwardly, away from the boats centerline, to thereby clear the upper deck 43 for any of many reasons, some of which were mentioned in the previous paragraph. There are three lock positions for the swing frame over the area of swing within the boat. There are two lock positions over the boat side edge and there are three lock positions outside the boat. These positions are a matter of choice and purpose. Prior art boat seats have one location, and that is it. One of the great choices is to get rid of any seat not wanted at a given time by simply unlocking its present position and putting it somewhere else. You can even store it completely outside of the boat, until you want it again. It should be noted that my swing seating machine is made up of three parts. Each part is a unit in itself. Unit 1 is the commercially purchased padded seat with strong arm rests 4 bolted to my inertia controlled swing pivot arm plate 22 FIGS. 7 and 8, at its distal end through the slots 25 thereof. Unit 2 is the swing frame machine 2 FIG. 1 that supports and holds seat 4 and plate 22 out at its radial distal outer end by its hole 13 which encompasses the pin 24 of the seat 4 and plate 22 at its axis and said machine 2 is supported by its tubular member 10 FIG. 5 on the axis section 6 of support pedestal 1 FIGS. 1, 2 and 3 or pedestal 1*x* FIGS. 16, 20, 21 and 22. The unit 2 has many parts, 5 of them are moveable. The unit three of the three unit combination is the vertical axis pedestals 1 and 1*x*. Pedestal 1 is the pedestal which is welded to base plate 5 and gussets 8 FIGS. 1, 2 and 3, which is made to be fastened to any boats deck, as used on my deck 43 FIG. 17, whereas pedestal 1*x* FIGS. 21 and 22 does the same job as pedestal 1 FIG. 17 does but it has no base plate 5. It is constructed of the same tubular stock and has the same section 6 FIG. 3 construction. It is about a foot longer and is vertically set in the sidewalls of boats FIGS. 21 and 16.

Figure 5:
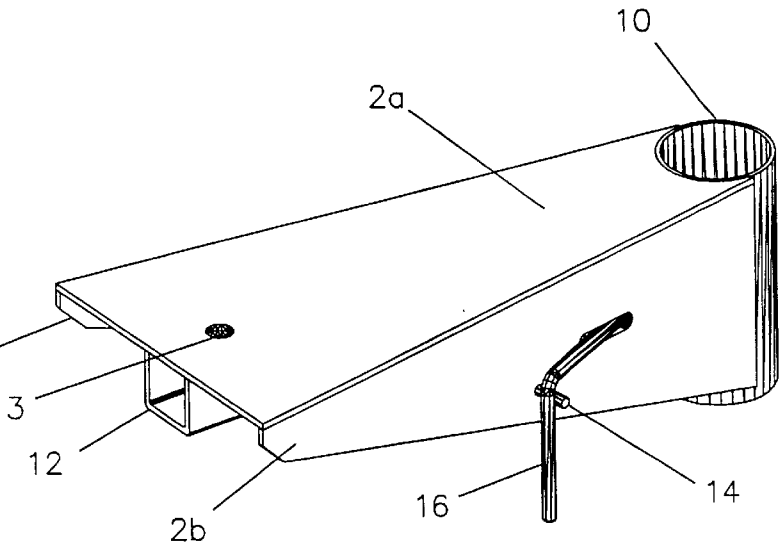
FIG. 5 is another perspective view of the swing frame shown in FIG. 4, but in upright position and taken from above.

Earlier note has been made of the locking capability of the swing frame machine 2 FIG. 5 but coverage of how plate 5 FIG. 17 is fastened to the deck 43 has been slight. First, there are many standard commercial fasteners that may be used, but choice of which may be governed by the situation. For the FIG. 17 boat, it is well to fasten plate 5 by using stainless steel metal screws that are at least 1 and ½ inches long if the deck is carpeted ¾ inch marine plywood with a sheet of metal beneath it. The holes 39 in the unique deck plate 5 are ¼ inch diameter so size 14 screws will be used. Pilot holes of not larger than ⅛ inch diameter may be used in the holes 39. The large majority of the holes 39 of plate 5 are much farther away from their pedestal 1 than the holes of prior art bases are from their pedestal. Therefore, fasteners used in the holes 39 of my plates 5 will be more effective than those used in the holes of prior art bases. In addition, base plate 5 has more fastener holes 39 than the number of fastener holes of any known prior art base. Therefore, push pull effect on base plate 5 fasteners will be less than that effect placed on fasteners used in prior art bases. Now we come to the torsion effect that fasteners in holes 39 of plate 5 are submitted to. Prior art bases have zero such rotational twist submitted to them. Their whole test is push pull.

Visualize my boat FIG. 17 with its base plates 5 mounted at the very deck 43 edges and with the seats locked in the 90 degree positions just as they are shown in FIG. 20. Now, they are not swing seats anymore. Seats 4 are positioned in holes 13 of the swing frames 2. Which, by inserting locking pin 16 into the proper hole 9 of pedestal 1, hole 13 was fused to non-rotational pedestal 1, making the location of seats 4 set, in relation to the boat, just as much as if they were mounted on prior art pedestals that go directly down from their seats and are fastened to the deck. Any shock to the hull will be felt instantly by their holes 13. This means that the thrust of our own powerful motor can be used to provide, at the driver's command, a violent vector from the rear and the load in the seats, at the time, will produce torque at the pedestals. Torque at the pedestals is reflected, instantly, out at the holes 39 of plate 5. The load we are referring to out at the swing ends of the locked frame 2 is naturally inertia reflected directly at the vector thrust of the big motor. The larger the load, the more the torque. This torque is a good thing. The seats on the starboard side of the boat will attempt to turn the base plates 5 in a counter clockwise direction and the seats on the port side of the boat will attempt to turn the base plates in a clockwise rotation. In both cases, the load passes to the pedestals and since the pedestals are welded to the base plates by gussets and other welds the twisting rotational torque is reflected instantly, and in unison at the holes 39 and thus to the fasteners. The stainless steel screw fasteners are instantly, together, pressured sideways. The force attempts to drive the top half of the screws one direction and the bottom half of the screws in the opposite direction. Since the screws are strong and stiff, the top half of the sharp threads bite into the material they are screwed into in one direction and at the same instant the bottom half of the screws bite into the material in the opposite direction. This stress is pressed against all of the screws together at the same instant. There is no such thing as force being able to attack the fasteners in any sequence, as a result nothing happens.

Figure 22:
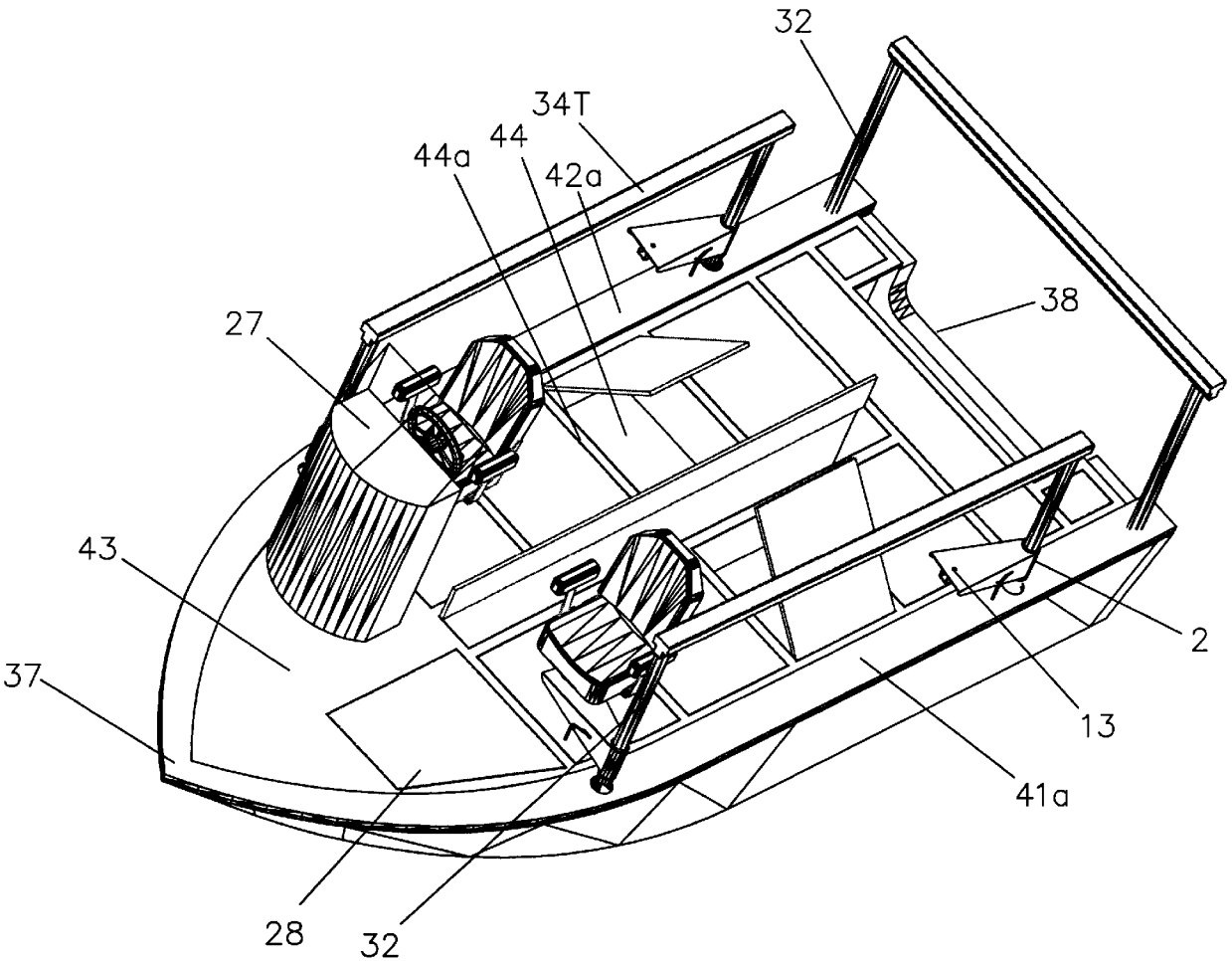
FIG. 22 is a prospective view of my invention, taken from above and ahead of the hull, the two forward seats are in the 90 degree position and the two aft seats have been unplugged from their swing frames and left home or put below deck in one of the holds, not shown and the aft swing frames have been swung under the railings and locked there.

Flexibility, is perhaps the key to the superiority of my boat with swing seating in that so many new things can be done safely. FIG. 22 shows us two of the swing frames hidden beneath the rails, locked in just over and along the side rails which has them there, out of the way. See plainly hole 13 of frame 2 FIG. 5 which also shows us the three members of sheet steel penetrated to act as hold and bushing to pin 24 FIGS. 7 and 8 and of the inertia control swing arm 22 FIGS. 7 and 8. The rectangular tube 12 FIG. 4 has two sheets penetrated and swing frame deck 2*a* of the swing frame 2 FIG. 5 has one of the ¾ inch penetration. This is a very strong hold and does not allow pin 24 to wobble in the least as it sits or pivots. It can be used for other things than just to support and handle pin 24. In addition to the view seen in FIG. 22 where the frame is locked just forward of the aft post supporting the rail on both sides of the boat, the frames can be locked just aft of the same supporting posts and three places outboard. Holes 9 FIG. 2 are placed every 45 degrees of the 360 degree circle of swing. The swing frames may be swung and locked at three outboard locations and the holes 13 therein may be used for various plug-in uses. One use is a Coleman cook plate mounted on a ¾ inch short rod. The public will find much more.

The Coast Guard guidlines for small open power boats is just under 26 feet in length. Which still provides room for additional swing seats, in addition to the two swing seats on each side which are necessary to hold up and support the railings. For the bigger of the small open power boats, the railings would preferrably be between 20 feet in length and 24 feet in length. These longer 34*t* railings still need post 32 support near their ends, just as the shorter ones did. In this case, the boat owner may want to install more swing seating between the swing seats already supporting the railings on each side of the boat.

Added seats, may or may not have, a post 32 in their access and egress pathway 45 to aid in the support of the railings. The strong pathway can egress many things from the hidden supply deck below the top deck 43. One thing very usable is 12 volt DC power. Another usable item is compressed air, for various uses. Pathway 45 is there, and I don't want to limit its uses by making further suggestions. In the case of pedestal 1 and plate 5, there is a one inch hole in plate 5 FIGS. 1, 2 and 3 right in the center of pathway 45. The hole, was put there to provide drainage to the bilge of any moisture from rain or otherwise and to provide access and egress to the between decks area for pathway 45. The hole is not shown in the drawings. The pedestal 1*x* FIG. 21, provides an interior tubing, pathway 45, that is 2 and ½ inches in diameter and goes deep into the boats interior.

Further understanding of deck usage and efficiency is aided by the knowledge that each hole 9, in section 6, of either pedestal 1 or 1*x* is directly opposite from the hole 9 on the other side of the pedestal. In other words, they are separated by 180 degrees and, in addition, each hole 9 is 45 degrees away from either of its neighboring holes 9. Also, when the pedestal was welded to the unique base plate 5 it was made sure that its bottom end was welded so that two of the holes 9, opposite from each other, would be oriented so that a line between them would be exactly parallel with the long side of base 5 so that when the base is mounted on the boat deck 43 with its long side edge on over and parallel to the fore and aft line of the boat side edge, the line between the holes 9 then will also lie over and parallel to the fore and aft line of the boat's side edges. One hole 9 will lie directly over the boats side edge on the forward side of the pedestal and the other will lie directly over the aft side of the pedestal. The rider may lock his seat on a hole 9 that presents his seat directly out from the sidewall as far as it will go. Which locks the seat at 90 degrees from the sidewall fore and aft line. Four seats 4 locked in the 90 degree position are shown in FIG. 20. The rider of each seat has two other settings of choice at which he can lock his seat. If he wishes to move his seat aft 45 degrees he must raise the hand hold of pin 16 up high enough to clear holding peg 14 and pull pin 16 out from the hole 9 it was locked in. He can then manually move his seat 4 slightly aft and let go of pin 16. He then, manually pushes his seat further aft and the pin 16 will seek and find the hole 9 that is 45 degrees aft of the hole 9 of the 90 degree setting. Gravity holds down the hand-hold part of the 90 degree bent pin 16 so that it can't work up over peg 14 and unlock the new setting. To move and lock his seat 4 foreword of the 90 degree setting, the procedure is the same, except the need to push the seat manually forward and lock it. When not traveling up on plane at high speed it is often comfortable and sensible to unlock the swing frames from the pedestals. Then, while fishing or doing other on-location activity, it is so easy to push the seats out of the way. It is not possible to do the same with prior art pedestal seats. Prior art pedestal seats are in the way all day, in use or not.

Explanation of the new life saving inertia control swing arm base plate 22 bolted to the base of chair 4 and plugged into hole 13 by its pivot pin 24 FIGS. 7 and 8 which is located at the distal end of swing frame 2 FIG. 5 is important. Any sharp shock, strong enough to knock the seat out from under the rider of a prior art pedestal seat, will still not be felt as shock in my inertia control swing arm seat. It will be felt as a firm twist, push and grab as he ends up between the arms of the seat and facing away from a long duration incoming vector.

Figures 9, 10, 11, 12:
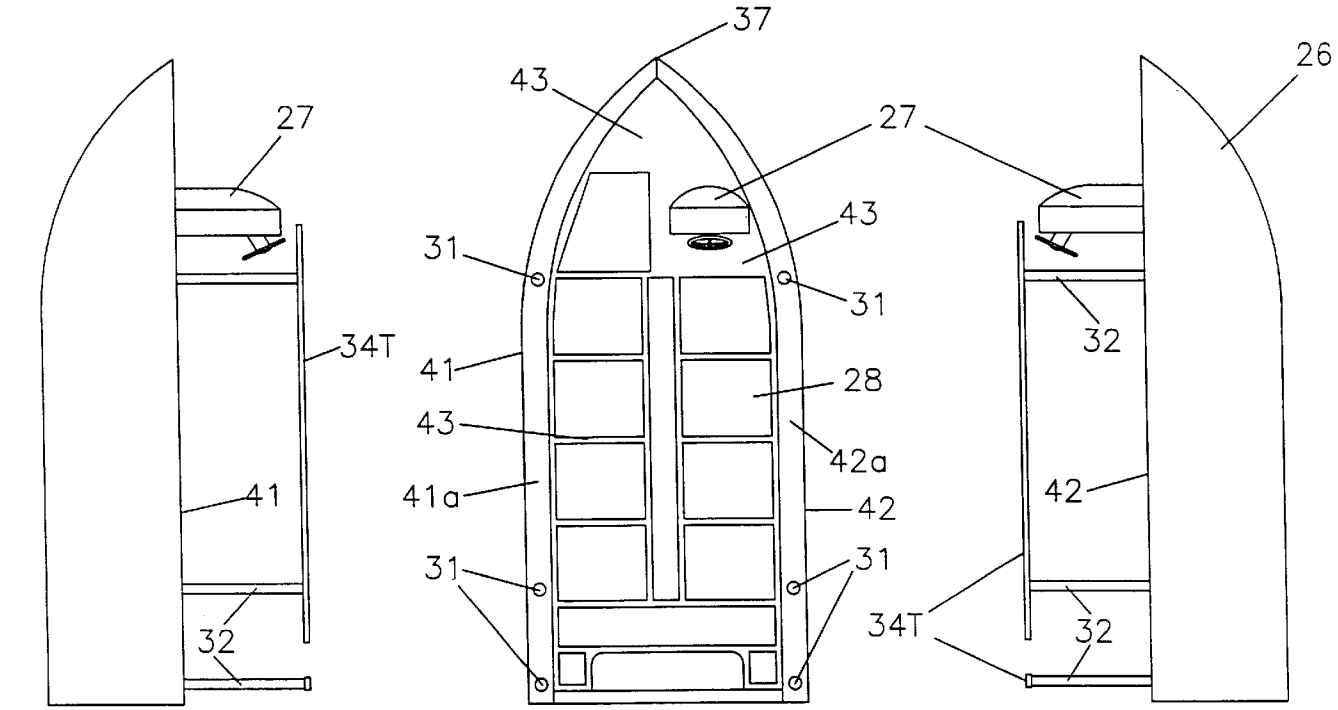
FIG. 9 is a port side elavational view of my boat, showing the relation between the hull, console or helm, and the side rail.
FIG. 10 is a top plan view of one of my boats in which over 90% of the top deck consists of closely adjacent hatch covers, and the chairs have been removed.
FIG. 11 is the starboard view of the preferred form of my invention.
FIG. 12 is a rear plan view of the hull, only, of my invention.
Figure 15:
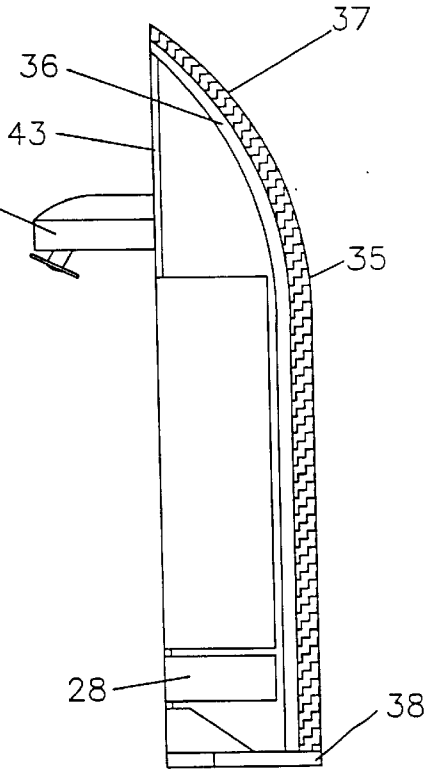
FIG. 15 is a vertical sectional view of the hull, taken along line B—B of FIG. 14.
Figure 14:
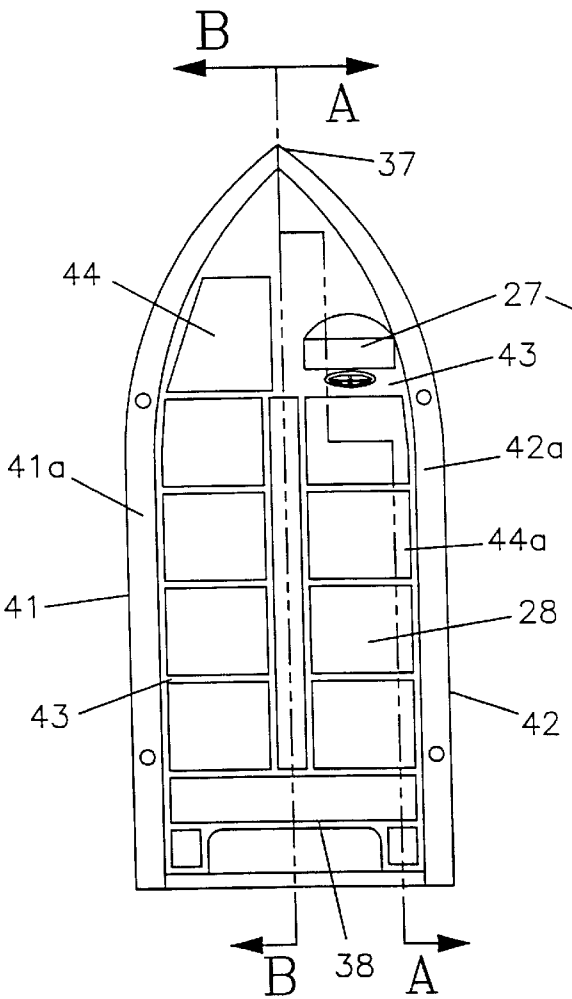
FIG. 14 is a top plan view of the preferred form of my invention, with the swinging chairs and rails removed.
Figure 13:
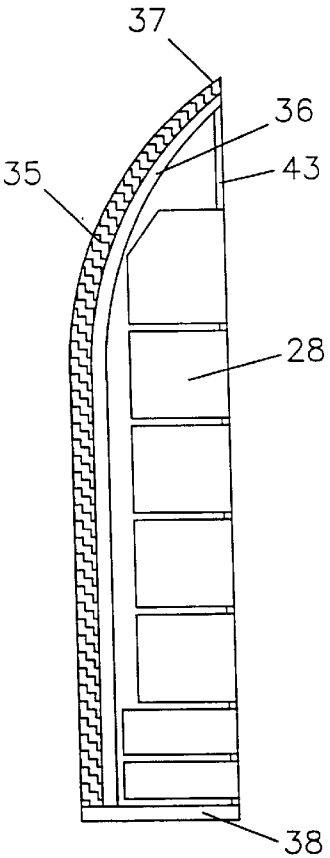
FIG. 13 is a vertical sectional view of the hull, only, of my invention, taken along line A—A of FIG. 14, with the swinging chairs, console and rails removed.

Real importance should be given to FIG. 11, the starboard view of the preferred form of my invention, because it shows clearly how high is the relationship of the railings 34*t* and the console 27 to the hull 26. We can see how both ends of the railing 34*t* are equidistant from the hulls 26, and therefore, since the railing 34*t* is attached to the tops of the vertical posts 32 by the tight grip T-bar post caps FIG. 18, and the posts bases are directly over the boats flat and straight side edge 42, the railings are parallel to the hull 26. Therefore, the area encompassed by the railing, the posts and the flat top edge of hull 26 is a parallelogram. Since the posts are shorter than the railing, the area is a rectangle. Hardboard and canvas are easily cut into such a shape for the making of a filler for the area.

Why fill the open area beneath the railings of my boat with swing seating? There are several reasons. One is that the boat owner may have small children that he wants to take out fishing or whatever. The hardboard panels, netting or canvas, firmly fastened beneath the railings, should help keep them aboard. A second reason is dryness. Even though his passengers are much less likely to get soaked from spray than those people riding down in a prior art boat, the situation can be improved by filling the space beneath the railings. A third speculative reason could be that the owner might like to sell advertising space on the high riding long panel.

Mounting of the above panel, netting or canvas is made extremely easy and effective because of the unique design of my 34*t* railings. FIGS. 19, 23A and 23B show the 34*t* railing. FIG. 23A shows the front view with the eight numbered surfaces of railing 34*t*. Character number 55 is the outboard lower vertical surface to which the panel or canvas should be fastened. The mid horizontal outboard surface 53 overhangs and protects anything mounted on surface 55. Market attachments are available for use on surface 55 as well as for use on surface 42*a* FIG. 17.

Inboard lower vertical character number 56 FIG. 23A is a valued surface for hanging items needed for immediate use, such as the throw life preserver now required by law.

Special note should be made here that front view FIG. 23A of the railings 34*t* is a shape and design limitation only. The railings may be made of hard wood, other material or be completely hollow in the interior as when constructed of extruded aluminum. When combining my swing seat open member 45, with the carrying capacity of railing support posts 32 and the capability of the motor to provide anti freeze laden hot water, we can have railings that don't become overloaded with ice. Many small open power boats are taken to sea in cold weather in search of food. Proper railings with adequate spray and water deflecting panels should make the job less killing.

Heretofore, we have been thinking and discussing the boat with swing seating competitive advantages in the horizontal field of action. However, now we should realize my swing seats capability to provide more comfort on the water in the form of softer ride, which is in the vertical action field. The inertia control swing arm plate 22 is also a form of lever. The weight of the person sitting in chair 4 presses down vertically to the distal end 3 FIG. 1. Bushing 23 FIGS. 7 and 8 permanently separates seat 4 from plate 2*a* of swing frame 2 FIG. 5 but in doing so also acts as a fulcrum for that length of swing arm 22 between it and the distal end 3 of 22 as the seat weight of the rider presses vertically downward on it. This leverage attempts to remove axis pin 24 FIGS. 7 and 8, out of hole 13 FIG. 5 at an impossible angle. This is a very stressful twist. Swing frame 2 can withstand it, without distortion, as long as the longitudinal axes (axis to distal end of each) of swing frame 2 and swing arm 22 are aligned and parallel. But, when the forward side of seat 4 and the backward side of seat 4 are faced directly across the longitudinal length of swing frame 2, the longitudinal length of swing arm 22 is directly crosswise and torque begins. Plates 2*a*, 2*b*, 2*c* and square tubular member 12 work together to fight the distortion. Temporary distortion does take place. The torsion takes place between tubular member 10 of swing frame 2 and distal hole 13 FIG. 5. This springing action softens, somewhat, the vertical upward blows of the boat hull.

An added advantage of my invention is that its construction is compatible with all conventional mechanized power means for propulsion.

It will, of course, be understood that various changes may be made in the form, details, arrangement and proportions of the parts without departing from the scope of the invention which comprises the matter shown and described here and set forth in the appended claims.

What is claimed is:

1. A small open power boat, under 26 feet in length, designed for more efficiency, safety and convenience, said boat having:

(a) a planing hull;

(b) a lower deck within said hull;

(c) an upper deck spaced from said lower deck;

(d) said hull having a plurality of opposing sidewalls defining an interior therebetween and having a bow and stern;

(e) said upper deck extending from bow point to stern transom in a single plane and remaining so to the top edges of the said boats sidewalls;

(f) said sidewalls each having an upper surface extending in a plane;

(g) said upper surface beginning at the juncture of transom and sidewall and running forward in a flat straight line to the point where the bow curve begins;

(h) said plane of said upper deck being disposed absolutely level with said plane of said upper surface of said sidewalls so that all water which may flow overboard in the event said boat encounters rough waters, with the exception of the seepage that gets between tight fitting edges of hatch covers;

(I) between said juncture of transom and the beginning bow curve is disposed a minimum of two swing seats with pedestals on each side of the, boat;

(j) said pedestals each support one end of a railing above them on each side of the boat;

(k) said transom has disposed above it a railing;

(l) said railings and said flat deck provide a safe, confined, walk-around area on the water; and (m) said boat provides a higher unobstructed view to the rider and presents a drier ride.

2. The boat defined in claim 1, wherein said upper deck is disposed in the same plane as said upper surfaces of said sidewalls.

3. The boat defined in claim 1, wherein the said upper deck extends fully from the bow to the stern of said boat.

4. The boat defined in claim 1, wherein the major portion of said upper deck is substantially clear of upstanding obstructions.

5. The boat defined in claim 1, wherein said upper deck is disposed in a plane located absolutely flat with the said upper surface of said sidewalls.

6. The boat defined in claim 1, wherein said upper deck is comprised of a flat panel having an opening therein, and (n) a plurality of closely adjacent hatch covers which have side edges of matching configuration and are disposed within said opening and jointly constitute with said opening a substantially continuous water-shedding surface.

7. The boat defined in claim 1, wherein said upper deck has a substantially planar upper surface with an opening therein, which is in effect substantially continuos in that a substantial portion thereof is comprised of a plurality of closely adjacent hatch covers which have side edges of matching configurations disposed within said opening, to thereby jointly constitute a substantially continuous water-shedding surface.

8. The boat defined in claim 1, and a plurality of swinging seats mounted along said opposing sidewalls.

9. The boat defined in claim 1, and a plurality of swinging seats mounted upon said upper surface of at least one of the said sidewalls.

10. The boat defined in claim 1, and at least one swinging seat mounted in supported relation along one of said sidewalls and being swingable outwardly of and above said supporting sidewall.

11. The boat defined in claim 1, and a plurality of swinging seats mounted upon said upper surface of each of said sidewalls in free-swinging relation.

12. The boat defined in claim 1, and at least one swinging seat mounted in supported relation along one of said sidewalls and being swingable outwardly beyond said supporting sidewall.

13. The boat defined in claim 1, wherein said upper deck is substantially clear except for a driver's helm located in the bow area.

14. The boat defined in claim 1, wherein a driver's helm is located on said upper deck on said bow, to provide clear driver vision at all speeds.

15. The boat defined in claim 1, wherein said upper deck is disposed at a plane level exactly even with the level of said upper surface of said sidewalls.

16. The boat defined in claim 1, and a plurality of swinging seats mounted along said opposing sidewalls, wherein said swinging seats are each carried by a swinging frame.

17. The boat defined in claim 16, and lock means carried by at least one of said swinging frames for locking its associated seat in any one of various positions.

18. The boat defined in claim 1, comprising:

(a) a chair structure for supporting a person while boating and having a forward and a rearward side;

(b) an upright pivot structure having a vertically extending pivot axis;

(c) a swinging frame swingably mounted on said pivot structure for swinging movement thereof in a generally horizontal plane about said vertically extending pivot axis; and (d) said swinging frame being swung pivotally connected in supporting relation to said chair structure at a distal point radially removed from the axis of said swinging movement of said swinging frame.

19. The boat defined in claim 18, wherein pivot structure under said chair structure comprises a vertical downward extending pivot pin from under the front of a swing plate disposed at a base of the chair structure; said swing plate attaches by plugging the pin into a hole at a distal end of the swinging frame; the pin pivoting when said swing plate and said chair structure swing; and wherein the chair structure can be swung by hand and a lifesaving swing of said chair structure can take effect when inertia of a passenger's body forces the chair structure to swing in response to an incoming violent vector.

20. The boat defined in claim 1 which the railings are high, have flat surfaces and provide easy use of commercial fasteners for whatever boating purpose.

21. The boat defined in claim 1 wherein at least four pedestals are used to support the railings, said pedestals being open, big enough and strong enough to make such support.

* * * * *